US010525367B2

(12) United States Patent
Takahashi

(10) Patent No.: US 10,525,367 B2
(45) Date of Patent: Jan. 7, 2020

(54) SPINNING TOP AND SPINNING TOP PRODUCTION METHOD

(71) Applicant: SPINNING TOP CORPORATION, Tsuchiura, Ibaraki Prefecture (JP)

(72) Inventor: Katsumi Takahashi, Tsuchiura (JP)

(73) Assignee: SPINNING TOP CORPORATION, Tsuchiura (JP)

( * ) Notice: Subject to any disclaimer, the term of this patent is extended or adjusted under 35 U.S.C. 154(b) by 0 days.

(21) Appl. No.: 16/097,425

(22) PCT Filed: May 2, 2017

(86) PCT No.: PCT/JP2017/017289

§ 371 (c)(1),
(2) Date: Oct. 29, 2018

(87) PCT Pub. No.: WO2017/191844

PCT Pub. Date: Nov. 9, 2017

(65) Prior Publication Data

US 2019/0176045 A1 Jun. 13, 2019

(30) Foreign Application Priority Data

May 6, 2016 (JP) ..... 2016-093424

(51) Int. Cl.
*A63H 1/04* (2006.01)
*A63H 1/00* (2019.01)

(52) U.S. Cl.
CPC ..... *A63H 1/04* (2013.01)

(58) Field of Classification Search
CPC ... A62H 1/04; A63H 1/16; A63H 1/00; A63H 1/18

(Continued)

(56) References Cited

U.S. PATENT DOCUMENTS 2,739,415 A * 3/1956 Roberton ..... A63H 1/00 446/263
2,937,472 A * 5/1960 Cunningham ..... A63H 1/04 446/263

(Continued)

FOREIGN PATENT DOCUMENTS

JP 56-059085 U1 5/1981
JP 10-057632 A 3/1998

(Continued)

OTHER PUBLICATIONS

"Vegoma," Wikipedia, (May 3, 2016), <https://ja.wikipedia.org/w/index.php?title=%E3%83%99%E3%83%BC%E3%82%B4%E3%83%9E&oldid=59590021>.

*Primary Examiner* — Nini F Legesse
(74) *Attorney, Agent, or Firm* — Lucas & Mercanti, LLP

(57) ABSTRACT

There is provided a spinning top excellent in the dimensional accuracy and excellent in the rotation balance and a method for manufacturing the spinning top.

The spinning top 100 includes a rotating shaft 110 and a rotating outer circumference section 120 that is fitted to the outer circumference of the rotating shaft 110 so as to be coaxial with the rotating shaft 110, in which the rotating shaft 110 includes a parallel section 112 that has a circular cylindrical shape parallel to the rotation axis AX of the rotating shaft 110 and is fitted to the rotating outer circumference section 120, a tapered section 114 that continues to the parallel section 112, inclines by a predetermined angle with respect to the rotation axis AX of the rotating shaft 110, and is fitted to the rotating outer circumference section 120, and a tip section 116 that continues to the parallel section 112 or the tapered section 114. Generally perfect concentricity can be achieved by fitting the rotating shaft 110 and the rotating outer circumference section 120 to each other through a fitting surface including the parallel section 112

(Continued)

and the tapered section 114. Thus, a spinning top excellent in the dimensional accuracy and excellent in the rotation balance can be provided.

21 Claims, 12 Drawing Sheets

(58) Field of Classification Search
USPC ..... 446/256, 258–260, 262–264
See application file for complete search history.

(56) References Cited

U.S. PATENT DOCUMENTS

| | | | | |
|---|---|---|---|---|
| 3,201,896 | A * | 8/1965 | Dalhart | A63H 1/18 446/69 |
| 5,498,192 | A * | 3/1996 | McKay | A63H 1/16 446/236 |
| 2013/0052909 | A1* | 2/2013 | Tsai | A63H 1/04 446/256 |

FOREIGN PATENT DOCUMENTS

| | | | |
|---|---|---|---|
| JP | 2003-135858 | A | 5/2003 |
| JP | 2004-329480 | A | 11/2004 |
| JP | 2007-209558 | A | 8/2007 |
| JP | 3136224 | U | 10/2007 |
| JP | 2011-206509 | A | 10/2011 |
| JP | 2015-194261 | A | 11/2015 |
| WO | 92/09349 | A2 | 6/1992 |

* cited by examiner

[Fig. 1]
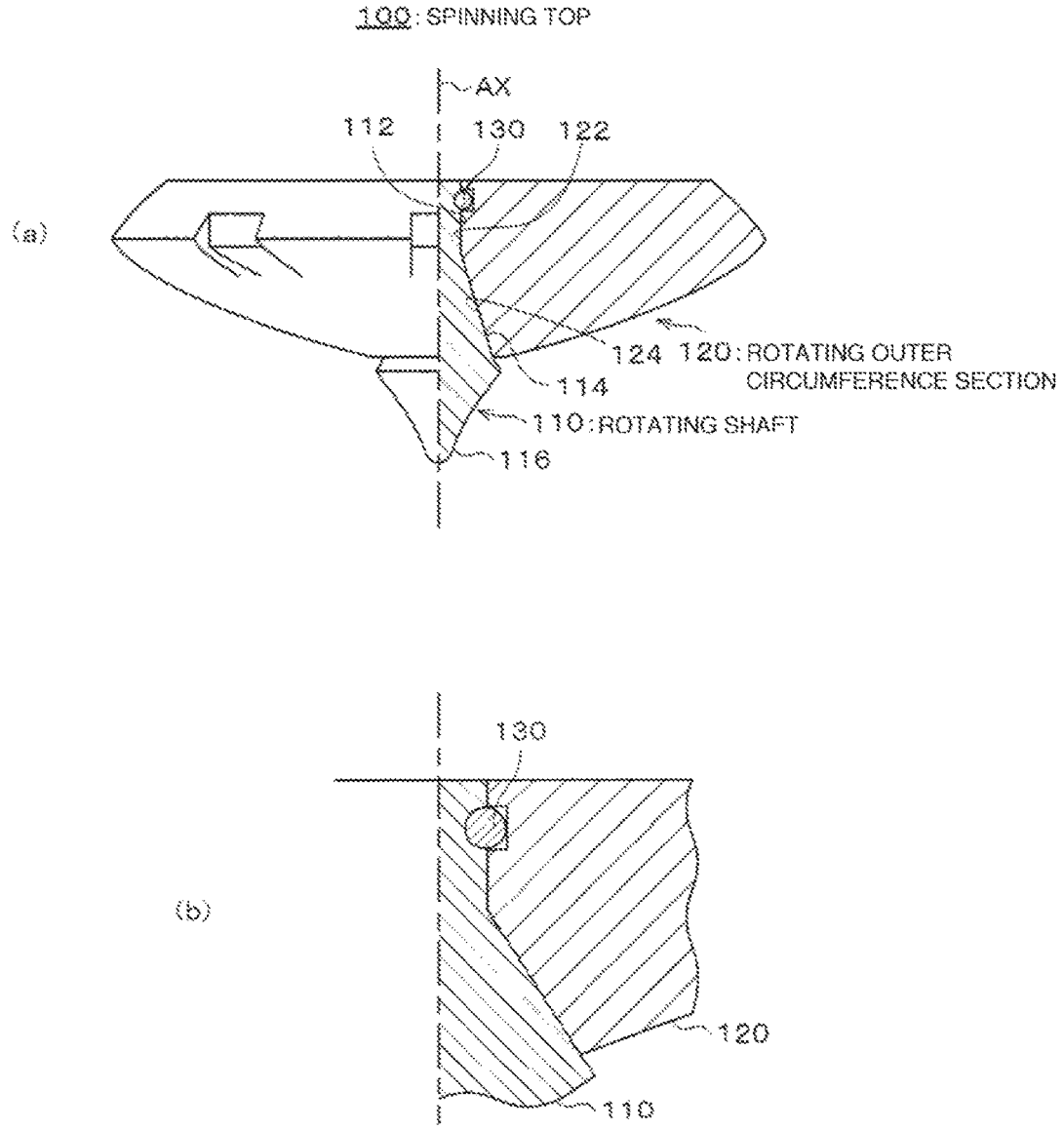

[Fig. 2]
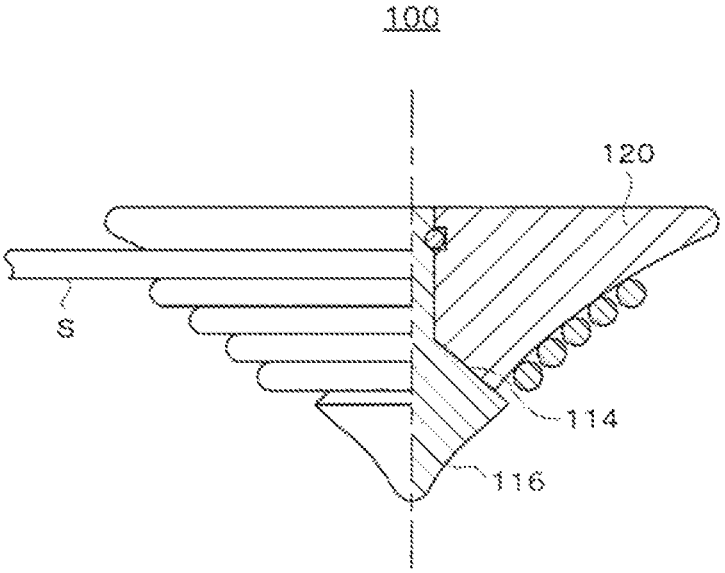

[Fig. 3]
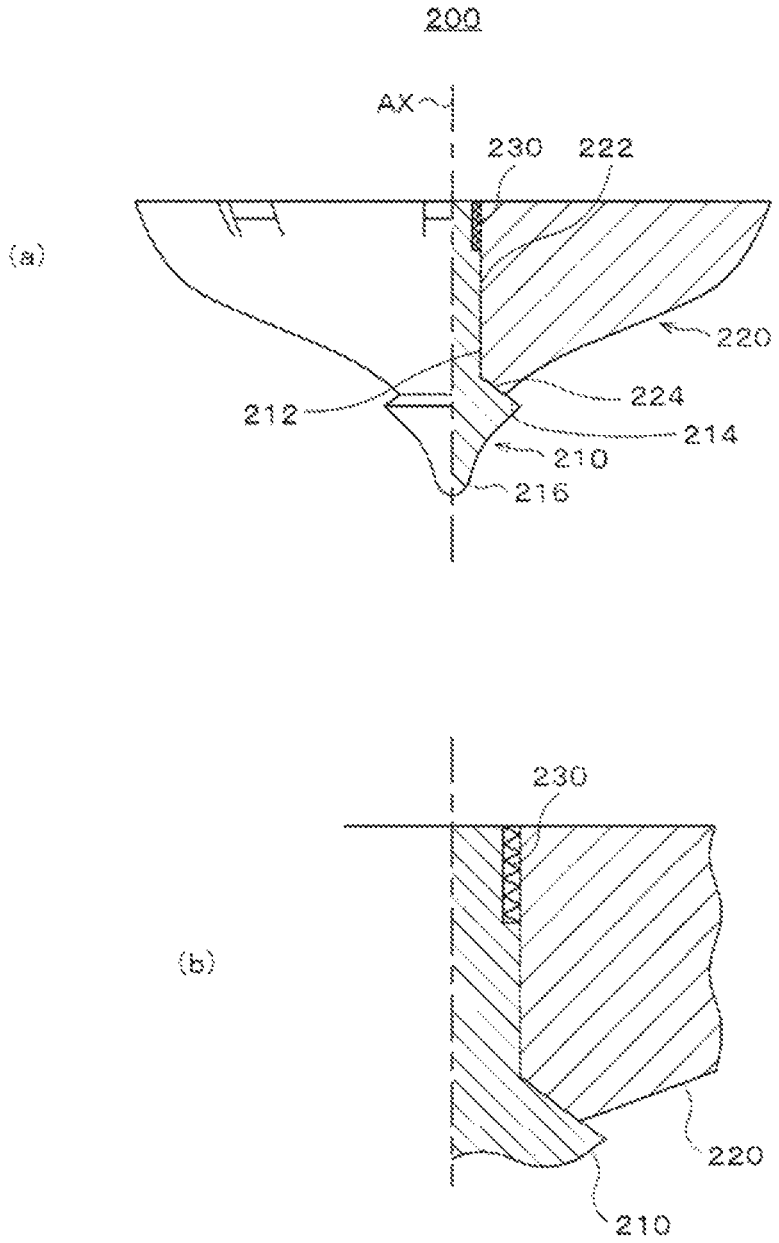

[Fig. 4]
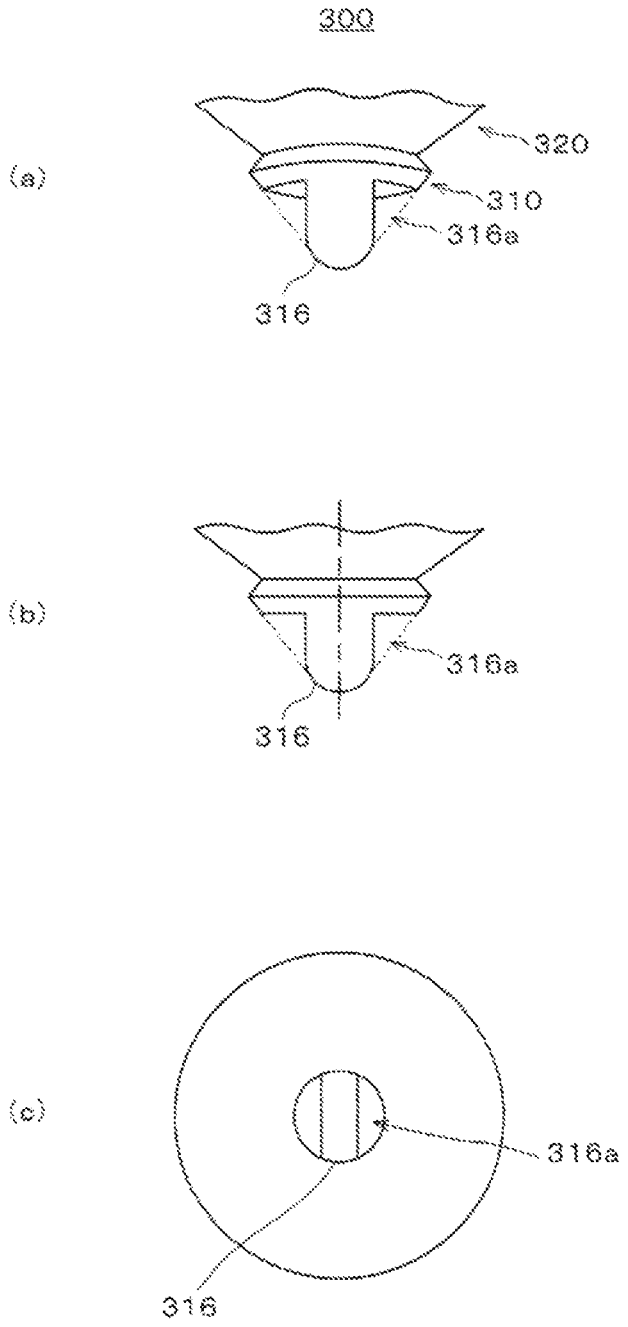

[Fig. 5]
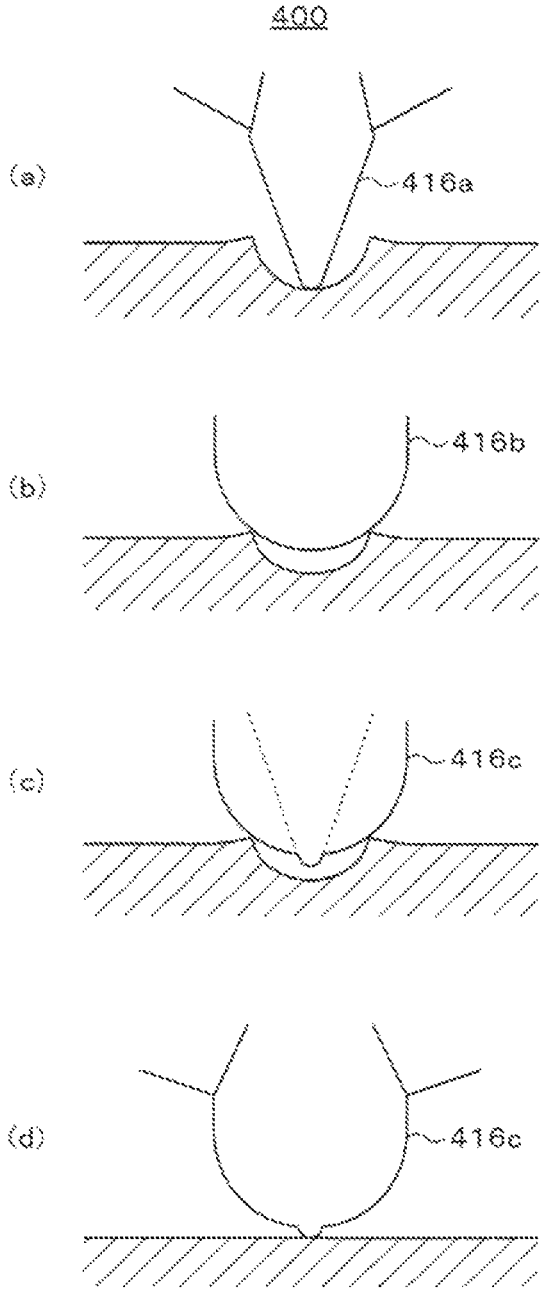

[Fig. 6]
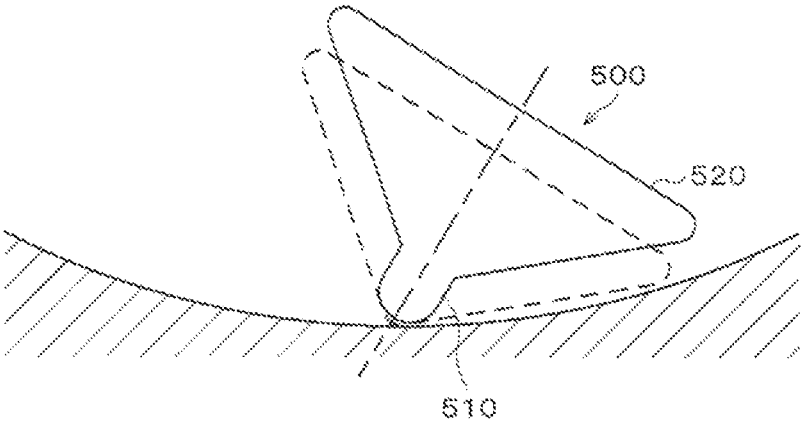
[Fig. 7]
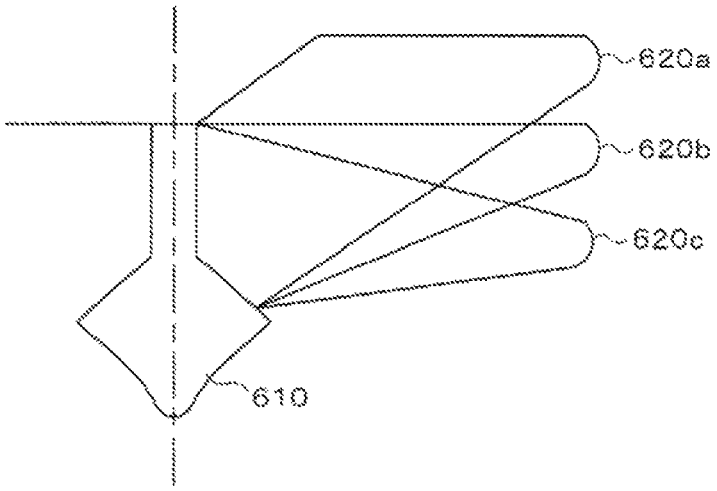

[Fig. 8]
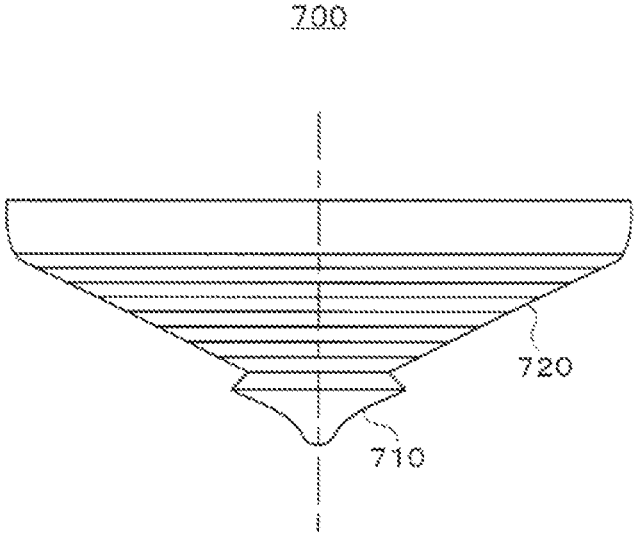
[Fig. 9]
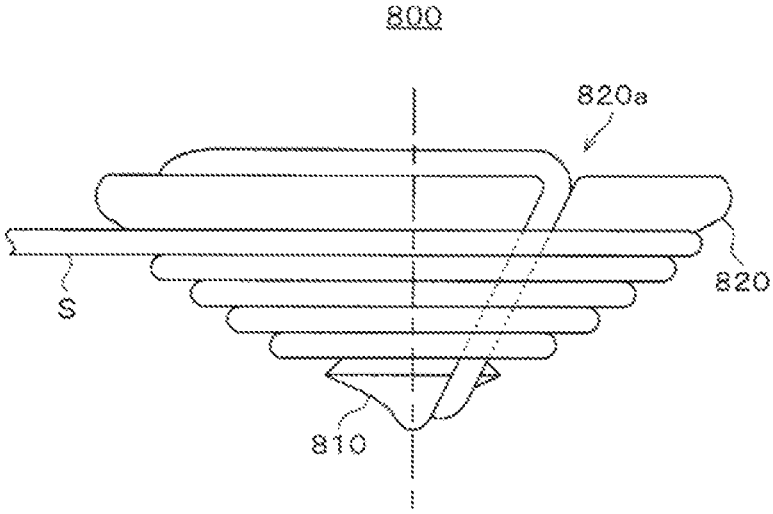

[Fig. 10]
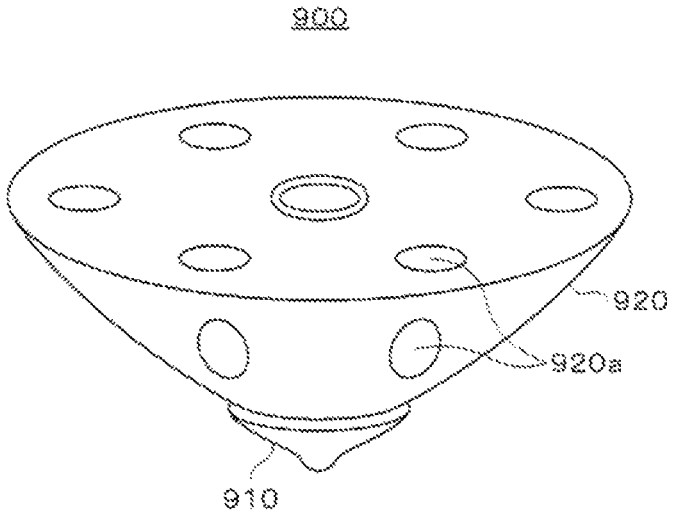
[Fig. 11]
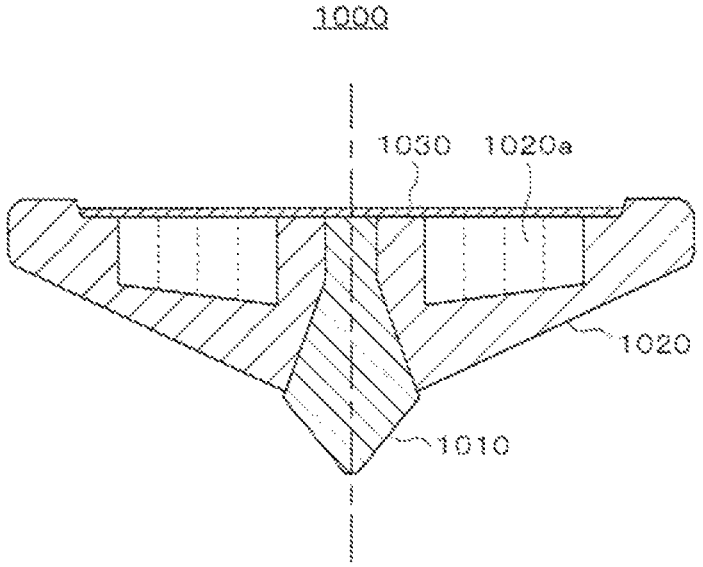

[Fig. 12]

| WEIGHT (g) | OUTER CIRCUMFERENCE SECTION OUTSIDE DIAMETER (mm) | | | | | | | | | | | | | | |
|---|---|---|---|---|---|---|---|---|---|---|---|---|---|---|---|
| | 25 | 27.5 | 30 | 32.5 | 35 | 37.5 | 40 | 42.5 | 45 | 47.5 | 50 | 52.5 | 55 | 57.5 | 60 |
| 30 | ○ | ○ | ○ | ○ | ○ | ○ | ○ | ○ | ○ | ○ | ○ | ○ | ○ | ○ | ○ |
| 35 | ○ | ○ | ○ | ○ | ○ | ○ | ○ | ○ | ○ | ○ | ○ | ○ | ○ | ○ | ○ |
| 40 | △ | ○ | ○ | ○ | ○ | ○ | ○ | ○ | ○ | ○ | ○ | ○ | ○ | ○ | ○ |
| 45 | △ | △ | ○ | ○ | ○ | ○ | ○ | ○ | ○ | ○ | ○ | ○ | ○ | ○ | ○ |
| 50 | △ | △ | △ | ○ | ○ | ○ | ○ | ○ | ○ | ○ | ○ | ○ | ○ | ○ | ○ |
| 60 | | △ | △ | △ | ○ | ○ | ○ | ○ | ○ | ○ | ○ | ○ | ○ | ○ | ○ |
| 65 | | △ | △ | △ | ○ | ○ | ○ | ○ | ○ | ○ | ○ | ○ | ○ | ○ | ○ |
| 70 | | | △ | △ | △ | ○ | ○ | ○ | ○ | ○ | ○ | ○ | ○ | ○ | ○ |
| 75 | | | △ | △ | △ | ○ | ○ | ○ | ○ | ○ | ○ | ○ | ○ | ○ | ○ |
| 80 | | | | △ | △ | △ | ○ | ○ | ○ | ○ | ○ | ○ | ○ | ○ | ○ |
| 85 | | | | △ | △ | △ | △ | ○ | ○ | ○ | ○ | ○ | ○ | ○ | ○ |
| 90 | | | | | △ | △ | △ | △ | ○ | ○ | ○ | ○ | ○ | ○ | ○ |
| 95 | | | | | △ | △ | △ | △ | △ | ○ | ○ | ○ | ○ | ○ | ○ |
| 100 | | | | | | △ | △ | △ | △ | △ | ○ | ○ | ○ | ○ | ○ |

○: STANDARD △: CUSTOM-MADE

[Fig. 13]
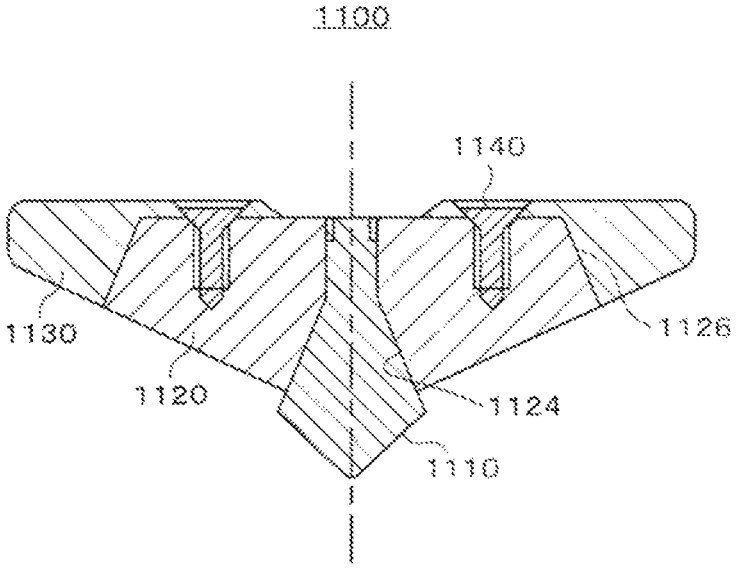

[Fig. 14]
(a) ROTATING SHAFT 1110
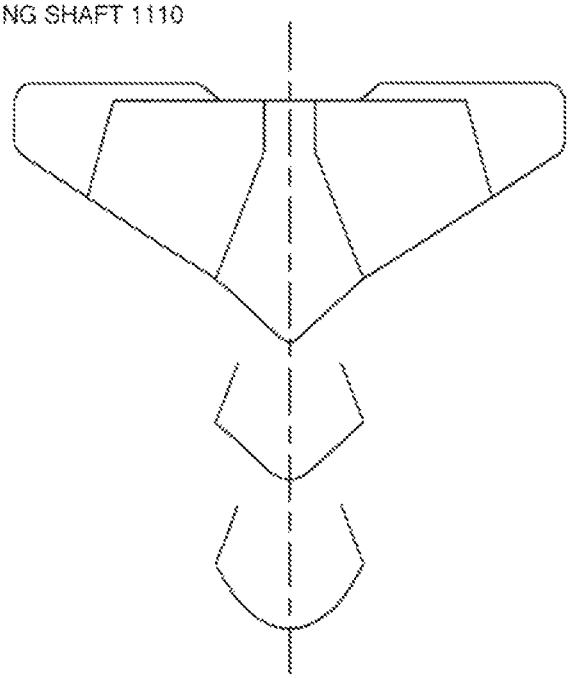
(b) OUTER CIRCUMFERENCE SECTION 1120
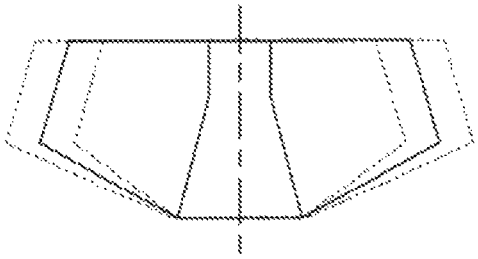
(c) ARMOR SECTION 1130
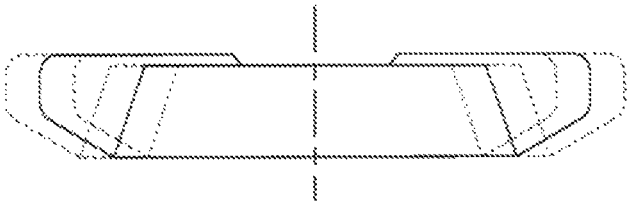

[Fig. 15]
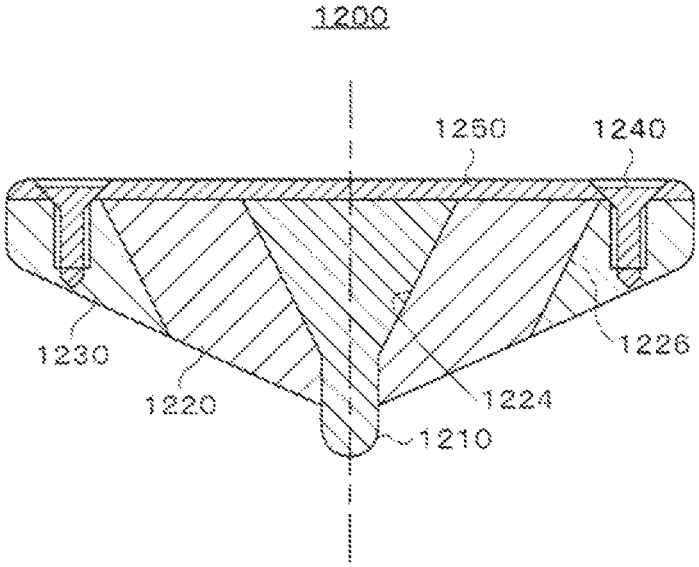
[Fig. 16]
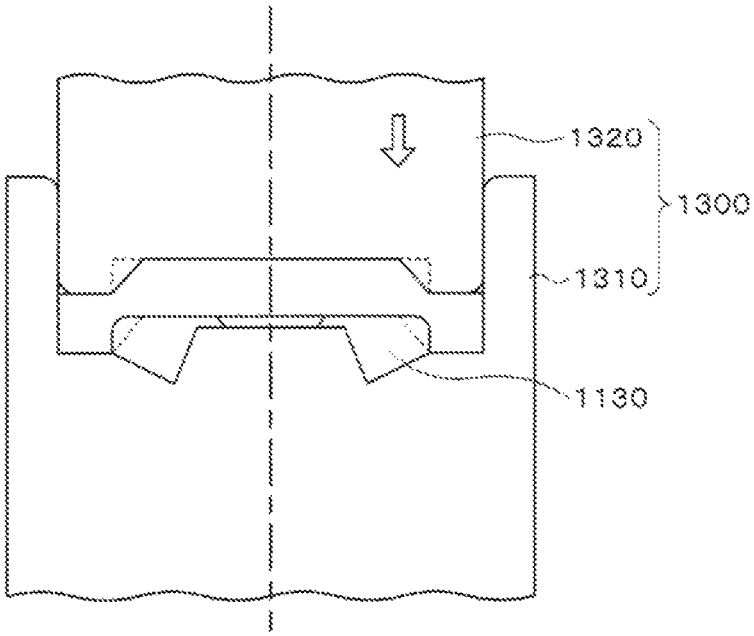

SPINNING TOP AND SPINNING TOP PRODUCTION METHOD

TECHNICAL FIELD

The present invention relates to a spinning top and a method for manufacturing the spinning top.

BACKGROUND ART

A beigoma (also called a baigoma) is a kind of a small spinning top. The spinning top was actively used in the play of Japanese children from around the Taisho era over to the years of spectacular economic growth. The spinning top of the related art was made of the ancient Japanese sand mold casting or made of the metallic mold casting (die cast).

CITATION LIST

Non-Patent Literature

Non-patent Literature 1: Internet <URL: https://ja.wikipedia.org/wiki/%E3%B3%99%E3%83%BC%E3%82%B4%E3%83%9E>

SUMMARY OF INVENTION

Technical Problems

However, the spinning top made of the sand mold casting is not precise in the shape and is inferior in the rotation balance. The surface is rough, and the friction resistance of the contact section against the floor is large daring rotation. Therefore, the spinning top ordinarily rotates for 1 minute or less only, and cannot rotate for a long time. Also, because the surface is comparatively hard, it is hard for a user to perform additional working (customizing) easily.

Also, the spinning top made of the metallic mold casting is excellent in the dimensional accuracy, excellent in the rotation balance, has a smooth surface, and is less in the friction resistance of the contact section. However, because the spinning top made of the metallic mold casting is formed of a comparatively soft metal, the contact section against the floor is inferior in the wear resistance and the shock resistance and has no durability. The outer peripheral section is liable to have a scratch by bumping of the top into one another. When the spinning top is metallic-mold casted by a hard metal having durability, because the spinning top is inferior in the machinability (workability), it comes hard for a user to perform additional working (customizing) easily.

The present invention has been achieved in view of such problems, and its object is to provide a spinning top excellent in the dimensional accuracy and excellent in the rotation balance and a method for manufacturing the spinning top.

Solution to Problem

In order to solve the problems described above, according to the first aspect of the present invention, there is provided a spinning top that includes a rotating shaft and a rotating outer circumference section that is fitted to the outer circumference of the rotating shaft so as to be coaxial with the rotating shaft, in which the rotating shaft includes a parallel, section that has a circular cylindrical shape parallel to the rotation axis of the rotating shaft and is fitted to the rotating outer circumference section, a tapered section that continues to the parallel section, inclines by a predetermined angle with respect to the rotation axis of the rotating shaft, and is fitted to the rotating outer circumference section, and a tip section that continues to the parallel section or the tapered section.

With such configuration, the rotating shaft and the rotating outer circumference section are fitted to each other by a fitting surface that includes the parallel section and the tapered section, and generally perfect concentricity can be thereby achieved. Thus, a spinning top excellent in the dimensional accuracy and excellent in the rotation balance can be provided.

The present invention can be applied variously as described below. Applications of the present invention explained below can be combined appropriately.

For example, the rotating shaft may be formed of any one of metal (titanium material, super hard alloy, stainless steel material, and the like), carbon, or polyacetal resin (alternative material of metal; known as Delrin (registered trade mark) whose raw material is formaldehyde, and hard material having lubricity. By configuring the rotating shaft thus, the rotating shaft low in the rotation resistance and excellent in the wear resistance and the shock resistance can be obtained. Therefore, rotation that is smooth for a long time can be achieved.

Also, the hard material having lubricity means a property (physical property) in which the surf ace/surface layer of material is slippery and hardly worn. For example, there is a metal whose surface is slippery obtained by that a lubricant is infiltrated into (contained by) a porous metal having a structure with many holes being opened such as a sponge. Also, a carbon raw material used for an electric motor, a rotary engine, and the like is also the hard material whose surface is slippery and hardly worn. Further, the contact surface of a pantograph of an electric train with overhead wires is also made of carbon that is slippery and hardly worn. Also, for example, by subjecting the surface of metal to a treatment, the friction coefficient can be reduced. For the rotating shaft of the present invention, such raw material whose friction coefficient is a constant value or less or raw material whose friction coefficient is reduced to a constant value or less can be used.

Further, it may be configured that the rotating outer circumference section is formed of a raw material where the specific weight is greater and the hardness is lower compared to the rotating shaft. By configuring the rotating outer circumference section thus, stable rotational force can be maintained for a long time, and additional working (customizing) becomes easy.

Also, the rotating shaft and the rotating outer circumference section may be freely assembled and disassembled. By making the rotating shaft and the rotating outer circumference section be freely assembled and disassembled, it is possible to construct a spinning top where the rotating shaft and the rotating outer circumference section are properly combined according to external factors such as a state of a cloth of the floor (a deck where the spinning top is rotated, a playing field) for example. At the time of a competition using a floor, the spinning tops of plural kinds with different radius of curvature of the contact section can be prepared for each basic shape such as "taka-oh" (high), "chu-oh" (middle), and "peh-oh" (low) of the spinning top according to the state of the cloth (unevenness, slipperiness, rotation friction, and the like caused by the roughness of the weave pattern and the strength of the tension) of the floor.

Also, an O-ring may be press-fitted between the rotating shaft and the rotating outer circumference section. With such configuration, the rotating shaft and the rotating outer circumference section can be easily assembled. Also, it may be made to preclude disassembling in an assembled state, or may be made to be capable of assembling and disassembling. Further, the O-ring may be arranged in the entire area of the parallel section. That is to say, the region of the parallel section may foe same to the width of the O-ring. Also, in this regard, the size of the O-ring may be decided according to the region of the parallel section, or the width of the region of the parallel section may be decided according to the size of the O-ring to the contrary.

Also, the rotating shaft and the rotating outer circumference section may be fastened to each other by a thread. With such configuration, the rotating shaft and the rotating outer circumference section can be easily assembled. Also, it may be made to preclude disassembling in an assembled state, or may be made to be capable of assembling and disassembling. Further, similarly to the above, the thread may be arranged in the entire area of the parallel section. That is to say, the region of the parallel section may be same to the width of the thread. Also, in this regard, the size of the thread may be decided according to the region of the parallel section, or the width of the region of the parallel section may foe decided according to the size of the thread to the contrary.

Further, in the tip section, plural notches may be arranged at positions that are rotationally symmetric to each other. Such notches can be used for hooking of a wrench for joining the rotating shaft to the rotating outer circumference section. Particularly, such notches are suitable in joining the rotating shaft to the rotating outer circumference section by a thread. Also, these notches can be used for a scape of a string that rotates the spinning top.

Further, the tip section may include a semispherical section and a protruding section that is arranged at the tip of the semispherical section. Thus, by employing a configuration of the semispherical section with comparatively large curvature (R) and the protruding section with comparatively small curvature, the spinning top can be made hard to be stuck in and easy to come cut from a dent of the floor by the semispherical section and can rotate for a long time with the rotation resistance with respect to the floor being reduced by the protruding section.

Also, the upper part of the tip section may be made larger than the outside diameter of the lowest surface of the rotating outer circumference section. By making the upper part of the tip section larger than the outside diameter of the lowest surface of the rotating outer circumference section, string tying of the spinning top becomes easy.

Also, the surface roughness of the rotating outer circumference section may be made coarse. By making the surface roughness of the rotating outer circumference section that is tied by the string coarse, the string becomes hard to slip against the rotating outer circumference section. Therefore, string tying becomes easy, and a rotational drive force from the string comes to be properly transferred, to the spinning top. Also, with respect to the surface roughness of the rotating outer circumference section, material whose surface is coarse may be used from the beginning, or working of making the surface roughness coarse may be performed.

Also, a string hooking groove may be configured in the rotating outer circumference section. For example, by arranging the string hooking groove from the outermost, circumference section of the rotating outer circumference section toward the rotating shaft of the inside, the string hooked to the rotating outer circumference section comes to be hardly shifted. Therefore, a rotational drive force from the string is properly transferred to the spinning top. Also, the string hooking groove may be arranged in any direction.

Further, in the rotating outer circumference section, a through hole, a dent, or a hollow section may be arranged. It is also possible to be configured to emit a sound during rotation by the through hole, the dent, or the hollow section arranged in the rotating outer circumference section. Because the sound emitted by the spinning top during rotation changes in the sound quality and the sound volume accompanying drop of the rotation speed, the degree of the drop of the rotation speed can be presumed. Also, by arranging the through hole, the dent, or the hollow section, the size and the mass of the spinning top can be adjusted.

The shape of the tapered section may have such direction that the maximum outside diameter part of the tapered section comes above the tip section, and may have such direction that the minimum outside diameter part of the tapered section comes above the tip section.

In order to solve the problems described above, according to the second aspect of the present invention, there is provided a spinning top obtained by that the spinning top of the first aspect of the present invention further includes an armor section that is attached to the outer circumference of the rotating outer circumference section so as to be coaxial with the rotating shaft. Also, the rotating outer circumference section and the armor section may be capable of assembling and disassembling, and may be of an integral fixed type. Because the armor section can be attached and detached or the armor sections of various forms can be prepared according to necessity, a top can be set easily in a competition of a top by selecting and combining the most suitable one out of plural kinds of components.

Also, the rotating outer circumference section may include a second tapered section that inclines by a predetermined angle with respect to the rotation center axis of the rotating shaft and is fitted to the armor section. Because the rotating outer circumference section and the armor section can be fitted to each other through tapered surfaces, the rotating shaft, the rotating outer circumference section, and the armor section can achieve perfect concentricity excellent in balance during rotation.

Also the spinning top of the second aspect of the present invention can be applied in a similar manner to the spinning top of the first aspect of the present invention.

In order to solve the problems described above, according to the third aspect of the present invention, there is provided a method for manufacturing the spinning top of the first aspect of the present invention. The method for manufacturing the spinning top of the present invention includes a step for manufacturing the rotating shaft by rotational machining by a lathe (an NC lathe and the like), a step for manufacturing the rotating outer circumference section by rotational machining by a lathe (an NC lathe and the like), and a step for assembling by fitting the rotating shaft and the rotating outer circumference section to each other.

By such method, because the rotating shaft is manufactured by rotational machining by a lathe (an NC lathe and the like), concentricity of each section with respect to the rotation center axis can be achieved generally perfectly, and the tapered section also can be configured precisely and can be mass-produced. Further, because the rotating outer circumference section is also manufactured by rotational machining by a lathe (an NC lathe and the like), concentricity of each section with respect to the rotation center axis can be achieved generally perfectly, and the tapered section also can be configured precisely and can be mass-produced. Also, with respect to assembling of the rotating shaft and the rotating outer circumference section, concentricity of each section with respect to the rotation center axis becomes generally perfect by fitting the tapered sections to each other, and such spinning top can be manufactured that is less in vibration during rotation and rotates for a long time extraordinarily smoothly.

In order to solve the problems described above, according to the fourth aspect of the present invention, there is provided a method for manufacturing the spinning top of the second aspect of the present invention. The method for manufacturing the spinning top of the present invention includes a step for manufacturing the rotating shaft by rotational machining by a lathe (an NC lathe and the like), a step for manufacturing the rotating outer circumference section by rotational machining by a lathe (an NC lathe and the like), a step for manufacturing the armor section by rotational machining by a lathe (an NC lathe and the like), and a step for assembling by fitting the rotating shaft and the rotating outer circumference section to each other and attaching the armor section to the outer circumference of the rotating outer circumference section.

Because the rotating shaft is manufactured by rotational machining by an NC lathe, concentricity of each section with respect to the rotation center axis can be achieved generally perfectly, and the tapered section also can be configured precisely and can be mass-produced. Also, because the rotating outer circumference section is also manufactured by rotational machining by an HC lathe and the like, concentricity of each section with respect to the rotation center axis can be achieved generally perfectly, and the tapered section also can be configured precisely and can be mass-produced. Further, because the armor section is also manufactured by rotational machining by an NC lathe and the like, concentricity of each section with respect to the rotation center axis can be achieved generally perfectly, and the tapered section also can be configured precisely and can be mass-produced. With respect to assembling of the rotating shaft, the rotating outer circumference section, and the armor section, concentricity of each section with respect to the rotation center axis can be achieved generally perfectly by fitting the tapered sections to each other, and such spinning top can foe achieved that is less in vibration during rotation and rotates for a long time extraordinarily smoothly.

In the manufacturing method described above, after the step of manufacturing the rotating shaft by rotational machining, a process for the rotating shaft combining any or a plurality of a quenching process, a titanium coating process, a plating process, or a mirror-polish finishing process may be included. The hardness can be increased by the quenching process. Also, by performing various processes, the wear resistance and the shock resistance can be improved, and rotation smooth for a long time and less in the resistance can be achieved.

In order to solve the problems described above, according to the fifth aspect of the present invention, there is provided another method for manufacturing the spinning top of the first aspect of the present invention. The method for manufacturing the spinning top of the present invention includes a step for manufacturing the rotating shaft by a metallic mold casting method (die cast) or a sintering method, a step for manufacturing the rotating outer circumference section by a metallic mold casting method (die cast) or a sintering method, and a step for assembling by fitting the rotating shaft and the rotating outer circumference section to each other.

Thus, the rotating shaft and the rotating outer circumference section can be manufactured also by the metallic mold casting method (die cast) or the sintering method. Thereby, with respect to assembling of the rotating shaft and the rotating outer circumference section, concentricity of each section with respect to the rotation center axis can be achieved generally perfectly by fitting the tapered sections to each other, and such spinning top can be achieved that is less in vibration during rotation and rotates for a long time extraordinarily smoothly. Also, to manufacture the rotating shaft by the sintering method and to manufacture the rotating outer circumference section by the metallic mold casting method (die cast) is optimum from an aspect of the cost and the like.

In order to solve the problems described above, according to the sixth aspect of the present invention, there is provided another method for manufacturing the spinning top of the second aspect of the present invention. The method for manufacturing the spinning top of the present invention includes a step for manufacturing the rotating shaft by a metallic mold casting method (die cast) or a sintering method, a step for manufacturing the rotating outer circumference section by a metallic mold casting method (die cast) or a sintering method, a step for manufacturing the armor section by a metallic mold casting method (die cast) or a sintering method, and a step for assembling by fitting the rotating shaft and the rotating outer circumference section to each other and attaching the armor section to the outer circumference of the rotating outer circumference section.

Thus, the rotating shaft, the rotating outer circumference section, and the armor section can be manufactured also by the metallic mold casting method (die cast) or the sintering method. Thereby, with respect to assembling of the rotating shaft, the rotating outer circumference section, and the armor section, concentricity of each section with respect to the rotation center axis can be achieved generally perfectly by fitting the tapered sections to each other, and such spinning top can be achieved that is less in vibration during rotation and rotates for a long time extraordinarily smoothly. Also, to manufacture the rotating shaft by the sintering method and to manufacture the rotating outer circumference section and the armor section by the metallic mold casting method (die cast) is optimum from an aspect of the cost and the like.

In the manufacturing methods described above, it is also possible that the rotating outer circumference section is formed of aluminum and a step for subjecting the rotating outer circumference section to an alumite treatment (of various colors) for coloring is included. By the alumite treatment, spinning tops of various colors can be manufactured.

Advantageous Effects of Invention

According to the present invention, a spinning top excellent in the dimensional accuracy and excellent in the rotation balance and a method for manufacturing the spinning top can be provided. Other effects of the present invention will be explained also in the paragraphs of the embodiments below.

BRIEF DESCRIPTION OF DRAWING

FIG. 1 (First embodiment) FIG. 1 is a drawing that shows a configuration of a spinning top 100, (a) is a partial cross-sectional side view, and (b) is an enlarged view of a portion of an O-ring 130 of (a).

FIG. 2 is a drawing that shows a state the rotating shaft is made larger than the lowest surface of the rotating outer circumference section.

FIG. 3 (Second embodiment) FIG. 3 is a drawing that shows a configuration of a spinning top 200, (a) is a partial cross-sectional side view, and (b) is an enlarged view of a portion of a thread 230 of (a).

FIG. 4 (Third embodiment) FIG. 4 is a drawing that shows a configuration of a tip section 316 of the rotating shaft of a spinning top 300, (a) is a perspective view, (b) is a side view, and (c) is a bottom view.

FIG. 5 (Fourth embodiment) FIG. 5 is a drawing that shows a variation of the tip section, (a) shows a tip section having a small curvature, (b) shows a tip section having a large curvature, and (c) and (d) show a state of arranging a protrusion.

FIG. 6 (Fifth embodiment) FIG. 6 is a drawing that shows a state the radius of curvature and the height of the tip section are reserved sufficiently.

FIG. 7 (Sixth embodiment) FIG. 7 is a drawing that shows a variation of the rotating outer circumference section.

FIG. 8 (Seventh embodiment) FIG. 8 is a drawing that shows a state the surface of the rotating outer circumference section is made coarse.

FIG. 9 (Eighth embodiment) FIG. 9 is a drawing that shows a state a groove for hooking a string is arranged.

FIG. 10 (Ninth embodiment) FIG. 10 is a drawing that shows a spinning top in which through holes or dents are arranged.

FIG. 11 (Tenth embodiment) FIG. 11 is a drawing that shows a state hollow sections are arranged in the rotating outer circumference section.

FIG. 12 is a drawing that shows a relation between the outside diameter of the outer circumference section and the mass.

FIG. 13 (Eleventh embodiment) FIG. 13 is a drawing that shows a configuration of a spinning top in which an armor section is arranged.

FIG. 14 is a drawing for explaining the size of a spinning top, (a) shows a rotating shaft, (b) shows a rotating outer circumference section, and (c) shows an armor section.

FIG. 15 is a drawing that shows a configuration of another spinning top in which an armor section is arranged.

FIG. 16 is a drawing that shows a method for manufacturing an armor section.

DESCRIPTION OF EMBODIMENTS

Below, preferable embodiments of the present invention will be explained in detail referring to attached drawings. Also, in the present description and drawings, with respect to configuration elements having a substantially same functional configuration, duplicated explanation will be omitted by imparting a same reference sign.

First Embodiment

The first embodiment of the present invention will, be explained. A configuration of the spinning top 100 related to the present embodiment will be explained referring to FIG. 1 and FIG. 2.

As shown in FIG. 1, the spinning top 100 mainly includes a rotating shaft 110, a rotating outer circumference section 120 that is attached to the outer circumference of the rotating shaft 110 so as to be coaxial with the rotating shaft 110, and the O-ring 130. FIG. 1 (*b*) is an enlarged view of a portion of the O-ring 130 of FIG. 1 (*a*). The rotating shaft 110 and the rotating outer circumference section 120 can be assembled and disassembled. Similarly to a general spinning top, the shape of the spinning top 100 is a comparatively shallow circular conical shape, a shaft does not protrude from the upper surface, and the upper surface is generally flat. Below, each configuration element of the spinning top 100 will be explained in detail.

(Rotating Shaft 110)

As shown in FIG. 1, the rotating shaft 110 is configured to be rotationally symmetric with respect to an axis AX. The axis AX is a rotation axis of the spinning top 100, and is a rotation axis of the rotating shaft 110. The rotating shaft 110 includes a first parallel section 112 that is parallel to the axis AX, a first tapered section 114 that continues to the first parallel section 112 and inclines by a predetermined angle (approximately 5°-50°) with respect to the axis AX, and a tip section 116 that continues to the first tapered section 114. The portion of the first parallel section 112 has a circular cylindrical shape, and the portion of the first tapered section 114 has a generally circular conical shape (a generally chevron shape) widening from the circular cylindrical portion of the first parallel section 112. These first parallel section 112 and first tapered section 114 become a fitting surface against the rotating outer circumference section 120 described below. Further, although it is not illustrated in FIG. 1, at the upper part of the first parallel section 112, roundness (R) may be arranged at the corner in order to facilitate fitting with the rotating outer circumference section 120 described below.

The rotating shaft 110 includes a tip section 116 so as to continue to the first tapered section 114. The tip section 116 is a portion that contacts the floor, has a reversed shape of a generally circular conical shape (a generally chevron shape) in an example shown in FIG. 1, and has a generally semispherical shape at its distal end. Above the tip section 116, there is provided the maximum outside diameter part of a second tapered section 124 of the rotating outer circumference section 120 described below.

As shown in FIG. 1, the rotating shaft 110 is characterized to foe made slightly larger than the outside diameter of the lowest surface of the rotating outer circumference section 120. This is for convenience when a string ties the spinning top 100. As shown in FIG. 2, because there is a portion of the rotating shaft 110 slightly larger, hooking of a string S is easy.

The rotating shaft 110 can be configured of metal (titanium material, super hard alloy, stainless steel material, and the like), carbon, or polyacetal resin (alternative material of metal; known as Delrin (registered trade mark)) whose raw material is formaldehyde, hard material having lubricity, and so on. Also, the hard material having lubricity means a property (physical property) in which the surface/surface layer of the material is slippery and hardly worn. For the rotating shaft 110, such raw material whose friction coefficient is a constant value or less or a raw material whose friction coefficient is reduced to a constant degree or less can be used.

The rotating shaft 110 was explained above. Next, the rotating outer circumference section 120 will be explained.

(Rotating Outer Circumference Section 120)

The rotating outer circumference section 120 is attached to the outer circumference of the rotating shaft 110 so as to be coaxial with the rotating shaft 110. The rotating shaft 110 and the rotating outer circumference section 120 may be freely assembled and disassembled, and may be made to preclude disassembling. The rotating outer circumference section 120 is configured to be rotationally symmetric with respect to the axis AX. The axis AX is a rotation axis of the spinning top 100, and is also a rotation axis of the rotation outer circumference section 120. In order to be fitted to the rotating shaft 110 described above, the rotating outer circumference section includes a second parallel section 122 that is parallel to the axis AX and the second tapered section 124 that continues to the second parallel section 122 and inclines by a predetermined angle with respect to the axis AX. The inclination angle of the second tapered section 124 is same to that of the first tapered section 114 of the rotating shaft 110 described above.

The rotating outer circumference section 120 is made of metal, or is configured of a hard material having lubricity. To be more specific, in case of metal, titanium material, super hard alloy, or stainless steel material for example can be used. Also, as the hard material having lubricity, polyacetal resin (alternative material of metal; known as Delrin (registered, trade mark)) whose raw material is formaldehyde can be used.

The material of the rotating outer circumference section 120 may be a same material of the rotating shaft 110, and may be a different raw material. For example, the material of the rotating outer circumference section 120 can be made metal having a greater specific gravity compared to the rotating shaft 110. By configuring the rotating outer circumference section 120 thus, a force stable for a long time can be maintained. Also, the material of the rotating outer circumference section 120 may also be metal having low hardness compared to the rotating shaft 110. By configuring the rotating outer circumference section 120 thus, additional work (customizing) is easy. Further, the rotating cuter circumference section 120 may also use a general material that is inexpensive and superior in rotational machining compared to the rotating shaft 110.

The outer circumference surface of the rotating outer circumference section 120 is a portion that configures the outer circumference surface of the spinning top 100. The outer circumference surface of the rotating outer circumference section 120 can be formed into an optional shape, and can be applied with various decorations. Also, the upper surface of the rotating outer circumference section 120 is flush with the upper surface of the rotating shaft 110, and the upper surface of the spinning top 100 is configured as a flat surface.

[O-Ring 130]

As shown in FIG. 1, the O-ring 130 is positioned between the rotating shaft 110 and the rotating outer circumference section 120. When the rotating shaft 110 and the rotating outer circumference section 120 are fitted to each other, the O-ring 130 is press-fitted between the rotating shaft 110 and the rotating outer circumference section 120, and fixes the both. With such configuration, the rotating shaft 110 and the rotating outer circumference section 120 can be easily assembled. In an example shown in FIG. 1, a grove is arranged in the rotating outer circumference section 120, and the O-ring 130 is arranged in the groove. However, the O-ring 130 may be arranged on the side of the rotating shaft 110. Also, instead of the O-ring, a C-shape or U-shape ring or a product similar to them may be used.

Above, a configuration of the spinning top 100 related to the present embodiment was explained. Next, a method for manufacturing the spinning top 100 will be explained.

First, the summary of a method for manufacturing the spinning top 100 will be explained.

The rotating shaft 110 is manufactured by rotational machining from a bar material by an NC lathe, the rotating outer circumference section 120 is manufactured by rotational machining by an NC lathe, and the rotating shaft 110 and the rotating outer circumference section 120 are assembled by fitting the first and second tapered sections 114 and 124 to each other. At the time of assembling, the rotating shaft 110 is inserted from below the rotating outer circumference section 120. At the time of disassembling, by pressing the rotating shaft 110 from the upper surface, the rotating shaft 110 is detached from the rotating outer circumference section 120. Also, during rotation of the spinning top 100, because a force is applied to the rotating shaft 110 only from below, there is no possibility that the rotating shaft 110 and the rotating outer circumference section 120 are disassembled unintentionally.

In an NC lathe, a numerical control device is attached in a lathe of various kinds, and it is allowed to instruct the moving distance and the feeding speed of the tool rest by numerical values. At present, control using a computer (CNC) is the mainstream. According to an NC lathe, because a product can be obtained with the accuracy of 0.005 mm or less, the first and second tapered sections 114 and 124 of the rotating shaft 110 and the rotating outer circumference section 120 can be fitted to each other strictly. However, it is not necessarily required to use an NC lathe, and an appropriate lathe can be used according to the required accuracy.

After the step for manufacturing the rotating shaft 110 by rotational machining, the rotating shaft 110 may be subjected to any one of a quenching process, a titanium coating process, a plating process, and a mirror-polish finishing process, or a process combining a plurality of them. By increasing the hardness by the quenching process or by performing various processes, the wear resistance and the shock resistance can be improved, and rotation that is smooth for a long time and less in the resistance can be achieved.

To be more specific, methods described below are preferable.

(1) The rotating shaft 110 is obtained by machining from a titanium material of a super hard alloy, and the tip section is subjected to mirror-polish finishing.

(2) The rotating shaft 110 is obtained by machining from a hard material having lubricity, and the tip section is subjected to mirror-polish finishing.

(3) The rotating shaft 110 is obtained by machining from a quenchable material such as an SK material (carbon tool steel material), is subjected to polish finishing, and is thereafter subjected to a quenching process.

(4) The rotating shaft 110 is obtained by machining from a stainless steel material and the like, is subjected to polish finishing, and is thereafter subjected to a titanium coating process.

(5) The rotating shaft 110 is obtained by machining from a stainless steel material and the like, is subjected to polish finishing, and is thereafter subjected to a Teflon (registered trade mark) coating process.

(6) The rotating shaft 110 is obtained by machining from a stainless steel material and the like, is subjected to polish finishing, and is thereafter subjected to a plating process.

Next, a method for manufacturing the rotating outer circumference section 120 will be explained. In order to achieve to maintain a rotational force stable for a long time at a low cost, the rotating outer circumference section 120 is manufactured by rotational machining so as to be suitable to the shape of the outer circumference section of the spinning top 100 from a round bar material or a polygonal bar material which is generally available, has a great specific gravity, and is easily machined. For the rotating outer circumference section 120, a material suitable to a quenching process such as an SK material (carbon tool steel material) can be used.

In concrete terms, the rotating outer circumference section 120 is manufactured by subjecting a round bar material having the diameter of 25 mm-60 mm or a polygonal bar material to rotational machining using an NC lathe, and is manufactured by forming the shape of the outer circumference section or the upper surface by pressing, and by being subjected to a post process making use of the material characteristics. Also, when the rotating outer circumference section 120 is made of aluminum, an alumite process of various colors may be performed for coloring.

Above, a method for manufacturing the spinning top 100 by a rotational machining step using an NC lathe was explained. Also, the spinning top 100 can be manufactured also by a metallic mold casting method (die cast) or a sintering method. That is to say, it is possible to manufacture the rotating shaft 110 by the metallic mold casting method or the sintering method, to manufacture the rotating outer circumference section 120 by the metallic mold casting method or the sintering method, and to assemble the rotating shaft 110 and the rotating outer circumference section 120 by fitting the first and second tapered sections 114 and 124 to each other. Also, to manufacture the rotating shaft 110 by the sintering method and to manufacture the rotating outer circumference section 120 by the metallic mold casting method is optimum from an aspect of the cost and the like.

(Effects of the First Embodiment)

As explained above, according to the present embodiment, the rotating shaft 110 and the rotating outer circumference section 120 are fitted to each other by the fitting surfaces formed of the first and second parallel sections 112, 122 and the first and second tapered sections 114, 124, and thereby generally perfect concentricity can be achieved. Thus, the spinning top 100 excellent in the dimensional accuracy and excellent in the rotation balance can be provided.

Also, because the upper part of the tip section 116 of the rotating shaft 110 is made larger than the outside diameter of the lowest surface of the rotating outer circumference section 120, hooking of the string S is easy. Further, the present invention is not limited to it, and the upper part of the tip section of the rotating shaft 110 may be made same to or smaller than the outside diameter of the lowest surface of the rotating outer circumference section 120.

Here, the difference between fitting by the first and second tapered sections 114, 124 (tapered surface fitting) of the present embodiment and a wedge joint of a general top will be explained. The tapered surface fitting of the present embodiment and the wedge effect used in fitting of a rotating shaft and an outer circumference section of a top are entirely different in terms of the use, object, and effects of them. The difference is as described below.

As the angle of the taper of the rotating shaft becomes gentle (as the change rate of the diameter reduces), the wedge effect appears greatly. Once the rotating shaft and the rotating outer circumference section are fitted to each other, it gradually becomes hard to draw out the rotating shaft from an object (outer circumference section) by the wedge effect. In wedge fitting used for fitting of the rotating shaft and the outer circumference section of a normal top, in order that the wedge effect is sufficiently exerted and the rotating shaft does not come out (does not slip off) from the outer circumference section, the change rate of the diameter is made sufficiently small (the angle of the taper is made gentle), and the rotating shaft is hit in to the outer circumference section with a large force or is pressed in by a strong force to be securely attached (to be fixed). In a top of an ancient Japanese type, although there exists one having such structure that the rotating shaft is configured to have a gentle taper, is hit in to the rotating outer circumference section, and is fitted by the wedge effect, the rotating shaft securely bites the rotating outer circumference section by the wedge effect and cannot be separated easily.

On the other hand, the tapered surface fitting of the rotating shaft 110 and the rotating outer circumference section 120 of the present embodiment achieved that the taper angle was set to a comparatively sharp angle at which the wedge effect did not appear clearly and easy attaching/detaching (joining/separating) was allowed, and that the rotating shaft 110 and the rotating cuter circumference section 120 were fitted to each other so as to be coaxial to the center axis AX of rotation. Although the angle of the taper of the tapered surface fitting differs more or less according to the material of the rotating shaft and the outer circumference section, approximately 5°-50° in terms of the angle of one side (approximately 10°-100° in terms of the opening angle of the taper) is suitable.

Below, applications of the first embodiment will be explained. In the embodiments described below, the structure of the spinning top will be explained, focusing the points different from the first embodiment. With respect to the method, for manufacturing the spinning top also, duplicated explanation of points substantially similar to the first embodiment will be omitted.

Second Embodiment

In the first embodiment, the O-ring 130 was explained as a configuration for making the rotating shaft 110 and the rotating outer circumference section 120 be freely assembled and disassembled. As shown in FIG. 3, the spinning top 200 of the present is characterized to arrange the thread 230 as a configuration for making a rotating shaft 210 and a rotating outer circumference section 220 be freely assembled and disassembled. Also, the rotating shaft 210 and the rotating outer circumference section 220 are substantially similar to the rotating shaft 110 and the rotating outer circumference section 120 of the first embodiment. That is to say, in FIG. 2, a parallel section 212, a tapered section 214, a tip section 216, a parallel section 222, and a tapered section 224 are substantially similar to the first parallel section 112, the first tapered section 114, the tip section 116, the second parallel section 122, and the second tapered section 124 of the first embodiment.

Similarly to the first embodiment, the rotating shaft 210 is inserted to the rotating outer circumference section 220 from below. Also, the rotating shaft 210 and the rotating outer circumference section 220 are assembled by the thread 230. Because a rotational force is transferred to a direction of fastening the thread by the string at the time of starting rotation of the spinning top 200, there is no possibility that the spinning top 200 is disassembled during rotation.

As explained above, according to the present embodiment, the rotating shaft 210 and the rotating outer circumference section 220 can be freely assembled and disassembled similarly to the first embodiment.

Third Embodiment

As shown in FIG. 4, a spinning top 300 of the present embodiment mainly includes a rotating shaft 310, and a rotating outer circumference section 320 that is attached to the outer circumference of the rotating shaft 310 so as to be coaxial with the rotating shaft 310. Below, the rotating shaft 310 and the rotating outer circumference section 320 will be explained focusing the points different from the rotating shaft 110 and the rotating outer circumference section 120 of the first embodiment.

As shown in FIG. 4, the spinning top 300 of the present embodiment is characterized to arrange 2 notches 316*a* at rotationally symmetric positions of the tip section 316 of the rotating shaft 310. FIG. 4 (*a*) is a perspective view, FIG. 4 (*b*) is a side view, and FIG. 4 (*c*) is a bottom view. These 2 notches 316*a* can be used for applying a wrench that is for joining the rotating shaft 310 to the rotating outer circumference section 320. Also, these 2 notches 316*a* are used for an escape of a string that rotates the spinning top 300.

Although 2 notches 316*a* are arranged in an example shown in FIG. 4, the number of pieces of the notch 316*a* is not limited to 2, and may be 1 or may be 3 or more. However, when the number of pieces of the notch 316*a* is an even number, because the notches 316*a* become rotationally symmetric, balance during rotation of the spinning top is excellent. Also, it is easy to apply a wrench. Particularly, when the rotating shaft 310 and the rotating outer circumference section 320 are joined to each other by the thread 230 as the second embodiment (FIG. 3), the notches 316*a* of an even number of piece are effective in applying a wrench.

Fourth Embodiment

As shown in FIG. 4, a spinning top of the present embodiment is characterized that the shape of a portion corresponding to the tip section 116 of the rotating shaft 110 of the spinning top 100 (FIG. 1) of the first embodiment is changed. Other points are substantially similar to the first embodiment. FIG. 5 (*a*) shows a tip section 416*a* having a small radius, FIG. 5 (*b*) shows a tip section 416*b* having a large radius, and FIGS. 5 (*c*) and (*d*) show a tip section 416*c* in which a protrusion section is arranged at the distal end of the hemispherical section.

As shown in FIG. 5 (*a*), when the radius of the curvature (R) of the tip section 416*a* is small, the spinning top cannot come out from the dent of the floor. Also, as shown in FIG. 5 (*b*), when the curvature of the tip section 416*b* is large, although the spinning top can come out from the dent of the floor, the resistance against the floor during rotation increases, and the spinning top does not rotate for a long time. Therefore, as shown in FIGS. 5 (*c*) and (*d*), by arranging a projection having a small radius at a tip section having a large radius, the spinning top can come out from the dent by the tip section having a large radius (FIG. 5 (*c*)), and rotates for a long time with the rotational resistance being less by the project ion having a small radius (FIG. 5 (*d*)).

Fifth Embodiment

As shown in a solid line of FIG. 6, a spinning top 500 of the present embodiment mainly includes a rotating shaft 510 and a rotating outer circumference section 520 that is attached to the outer circumference of the rotating shaft 510 so as to be coaxial with the rotating shaft 510. The spinning top of the present embodiment is characterized that the shape of the rotating shaft 510 and the rotating outer circumference section 520 is changed as shown in the solid line of FIG. 6. Other points are substantially similar to the first embodiment.

As shown in the solid line of FIG. 6, the spinning top 500 of the present embodiment is characterized that the height from the hemispherical section to the rotating outer circumference section 520 that is a circular conical section is sufficiently reserved for each radius of curvature of the hemisphere so that portions having same radius of curvature of the hemispherical section of the tip section of the rotating shaft 510 contact even when the spinning top rotates in a tilted state. Also, a broken line of FIG. 6 shows the shape of a spinning top of a prior art for comparison purpose.

As described above, according to the present embodiment, the rotating outer circumference section 520 can be prevented from contacting the floor even when the spinning top 500 rotates in a tilted state.

Sixth Embodiment

As shown in FIG. 7, a spinning top of the present embodiment is characterized that the shape of a portion corresponding to the rotating outer circumference section 120 of the spinning top 100 (FIG. 1) of the first embodiment is changed. Other points are substantially similar to the first embodiment.

As shown in FIG. 7, in the spinning top of the present embodiment, rotating outer circumference sections 620*a*, 620*b*, 620*c* with different shape can be optionally selected for a same rotating shaft 610. By rotational machining using an NC lathe, the rotating outer circumference section can be worked into optional shapes in addition to "taka-oh" (high) 620*a*, "chu-oh" (middle) 620*b*, "eh-oh" (low) 620*c*, and the like of the basic shape of the spinning top, and spinning tops of many variations can be manufactured.

As explained above, according to the present embodiment, because the rotating outer circumference sections 620*a*, 620*b*, 620*c* worked into optional shapes can be configured by rotational machining using an NC lathe, spinning tops of many variations can be configured.

Seventh Embodiment

As shown in FIG. 8, a spinning top 700 of the present embodiment mainly includes a rotating shaft 710 and a rotating outer circumference section 720 that is attached to the outer circumference of the rotating shaft 710 so as to be coaxial with the rotating shaft 710. Below, the rotating shaft 710 and the rotating outer circumference section 720 will be explained focusing the points different from the rotating shaft 110 and the rotating outer circumference section 120 of the first embodiment.

As shown in FIG. 8, the spinning top 700 of the present embodiment is characterized that the surface roughness of the rotating outer circumference section 720 is made coarse. As a concrete working process, anti-slipping work can be implemented by shaping the cutting edge of a tool into an acute angle and engraving a required portion with a fine and continuous groove. Also, the grove can be configured by making the shape of the cutting edge of the tool used in an HC lathe a hemispherical shape having the width of approximately 2 mm and working the required portion. Such groove functions as a guide groove for a string that is for rotating the spinning top 700. By arranging the guide grooves consecutively from the maximum outer circumference of the circular conical section of the rotating outer circumference section 720 downward (rotational axis direction), as shown in FIG. 8, the guide grooves for string hooking of 7-8 rows can be formed. By hooking the string to the guide grooves, the contact area of the spinning top 700 and the string increases, and therefore the friction also increases to hardly cause slipping.

Also, as the work for making the surface of the rotating outer circumference section 720 coarse, it is also possible to finish the surface coarse (to perform anti-slipping process) by simply subjecting a required portion to pear skin working and so on by sand blast and the like after machining of the rotating outer circumference section 720 by an NC lathe.

As explained above, according to the present embodiment, because the surface roughness of the rotating outer circumference section 720 tied by the string is made coarse, the string comes to hardly slip from the rotating outer circumference section 720. Therefore, a rotational driving force from the string is properly transferred to the spinning top 700.

Eighth Embodiment

As shown in FIG. 9, a spinning top 800 of the present embodiment mainly includes a rotating shaft 810 and a rotating outer circumference section 320 that is attached to the outer circumference of the rotating shaft 810 so as to be coaxial with the rotating shaft 810. Below, the rotating shaft 310 and the rotating outer circumference section 820 will be explained focusing the points different from the rotating shaft 110 and the rotating outer circumference section 120 of the first embodiment.

As shown in FIG. 9, the spinning top 800 of the present embodiment is characterized that a string hooking groove 820*a* for hooking the string S is formed in the rotating outer circumference section 820. The string hooking groove 820*a* is arranged from the outermost circumference section of the rotating outer circumference section 820 toward the rotating shaft 810 on the inner side. Also, the direction of the string hooking groove is not limited to an example shown in FIG. 9, and the string hooking groove can be formed in any directions.

As described above, according to the present embodiment, because the string hooking groove 820*a* is arranged, from the outermost circumference section of the rotating outer circumference section 820 toward the rotating shaft 810 on the inner side, the string S hooked to the rotating outer circumference section 820 comes to hardly shift. Therefore, a rotational driving force from the string S is properly transferred to the spinning top 800.

Ninth Embodiment

As shown in FIG. 10, a spinning top 900 of the present embodiment mainly includes a rotating shaft 910 and a rotating outer circumference section 920 that is attached to the outer circumference of the rotating shaft 910 so as to be coaxial with the rotating shaft 910. Below, the rotating shaft 910 and the rotating outer circumference section 920 will be explained focusing the points different from the rotating shaft 110 and the rotating outer circumference section 120 of the first embodiment.

As shown in FIG. 10, the spinning top 900 of the present embodiment is characterized that a through hole or a dent 920*a* is arranged in the rotating outer circumference section 920. The through hole or the dent 920*a* may be arranged by one number, or may be arranged by plural numbers. However, the through hole or the dent 920*a* does not affect the rotation balance of the spinning top 900 by adjusting the shape or the number so as to be arranged rotationally symmetrically.

The spinning top 900 emits a sound during rotation by the through hole or the dent 920*a* arranged in the rotating outer circumference section 920. Because the sound emitted by the spinning top 900 during rotation changes in the sound quality and the sound volume accompanying drop of the rotation speed, the degree of drop of the rotation speed can be presumed.

As described above, according to the present embodiment, because the sound quality and the sound volume change accompanying drop of the rotation speed by the sound emitted by the spinning top 900 during rotation, the degree of drop of the rotation speed can be presumed.

Tenth Embodiment

As shown in FIG. 11, a spinning top 1000 of the present embodiment mainly includes a rotating shaft 1010 and a rotating outer circumference section 1020 that is attached to the outer circumference of the rotating shaft 1010 so as to be coaxial with the rotating shaft 1010. Below, the rotating shaft 1010 and the rotating outer circumference section 1020 will be explained focusing the points different from the rotating shaft 110 and the rotating outer circumference section 120 of the first embodiment.

As shown in FIG. 11, the spinning top 1000 of the present embodiment is characterized that 1 or 2 or more hollow section 1020*a* is arranged, in the rotating outer circumference section 1020. In an example shown in FIG. 11, the hollow sections 1020*a* are arranged from the upper surface of the rotating outer circumference section 1020 toward the inside, and a cover 1030 is arranged so as not to be recognized from outside. However, it is also possible not to arrange the cover 1030. Thus, because the plural hollow sections 1020*a* are arranged, by changing the number of pieces and the shape of the hollow section 1020*a*, the size of the entire hollow section 1020*a* can be changed. Also, the hollow section 1020*a* does not affect the rotation balance of the spinning top 1000 by being arranged rotationally symmetrically.

Here, the relation between the outside diameter of the outer circumference section and the weight of the spinning top will be explained. FIG. 12 is a drawing that shows the relation between the outside diameter of the outer circumference section and the weight of a spinning top. As shown in FIG. 12, the weight of the spinning top increases proportionally to the second order of the outside diameter of the outer circumference section. In a spinning top competition, tops collide on each other on the floor, knuckle the counterpart top, and try conclusions. The magnitude of the kinetic energy of a spinning top calculated approximately by ½× (inertial weight of top)×(second order of rotation speed) is an important factor for determining the conclusions.

Because the spinning top of the present embodiment (and other embodiments) can replace the rotating outer circumference section against the rotating shaft, the size and the weight of the rotating outer circumference section can be selected according to the caliber of the user so that the kinetic energy of the top is maximized (so that the rotation speed is maximized and the weight becomes moderately heavy).

As described above, according to the present embodiment, because the hollow section 1020*a* is arranged, the size and the mass of the spinning top can be adjusted. For example, by changing the number and the shape of the hollow section 1020*a*, the weight can be changed without changing the dimension of the rotating outer circumference section 1020.

Also, in the present embodiment, it was explained to change the mass of the spinning top by arranging the hollow section 1020*a*. This is on the assumption that an owner of the spinning top customizes the spinning top. When it is intended only to increase the kinds of the spinning top that simply differs in the mass, the mass of the spinning top may be changed by changing the material of the spinning top for example. Further, the mass of the spinning top can be changed also by the through hole or the dent 920*a* explained in the ninth embodiment.

Eleventh Embodiment

The eleventh embodiment of the present invention will be explained referring mainly to FIG. 13-FIG. 16. In the first embodiment, a configuration of arranging the rotating outer circumference section 120 so as to be coaxial with the rotating shaft 110 was explained. The present embodiment is characterized to further arrange an armor section outside a rotating outer circumference section so as to be coaxial with a rotating shaft. In the present embodiment, duplicated explanation of the points similar to the first embodiment will be omitted, and explanation will be made focusing the points different from the first embodiment.

As shown in FIG. 13, a spinning top 1100 related to the present embodiment is characterized, to include a rotating shaft 1110 and a rotating outer circumference section 1120 that is attached, to the outer circumference of the rotating shaft 1110 so as to be coaxial with the rotating shaft 1110, and to be further provided with an armor section 1130. The armor section 1130 is attached to the outer circumference of the rotating outer circumference section 1120 so as to be coaxial with the rotating shaft 1110. Below, explanation will be made in order.

The rotating shaft 1110 is substantially similar to the rotating shaft 11 of the first embodiment. AS shown in FIG. 13, the point of the rotating outer circumference section 1120 different from the rotating outer circumference section 120 of the first embodiment is to include a tapered section 1124 that is for tapered surface fitting against the rotating shaft 1110, and to include a tapered section 1126 so as to be capable of tapered surface fitting of the armor section 1130 to the outer circumference side coaxially.

As shown in FIG. 13, the armor section 1130 is arranged from the outer circumference side of the rotating outer circumference section 1120 over to the upper surface. The rotating outer circumference section 1120 and the armor section 1130 are fixed to each other by screwing the upper part of the rotating shaft section 1120 and the upper part of the armor section 1130 by fixation screws 1140.

The armor section 1130 may be of material same to that of the rotating shaft 110 of the first embodiment, and may be of a different raw material. For example, the material of the armor section 1130 can be made metal whose specific gravity is greater than that of the rotating shaft 110. By configuring the armor section 1130 thus, a rotational force that is stable for a long time can be maintained. Also, the material of the armor section 1130 may be metal having a low hardness. By configuring the armor section 1130 thus, additional working (customizing) is easy. Further, the armor section 1130 may also use a general material that is inexpensive and superior in rotational machining compared to the rotating shaft 110.

With respect to the armor section 1130, as shown in FIG. 14 (*a*), the rotating shaft 1110 can change the magnitude of the radius of the tip section to small, medium, and large. Also, as shown in 14 (*b*), the diametral dimension of the rotating outer circumference section 1120 also can be changed to small (broken line in the drawing), medium (solid line in the drawing), and large (broken line in the drawing). Further, as shown in FIG. 14 (*c*), the diametral dimension of the armor section 1130 also can be changed to small, medium, and large. Furthermore, with respect also to the spinning top 1100 related to the present embodiment, the rotating shaft 1110, the rotating outer circumference section 1120, and the armor section 1130 may be made freely assembled and disassembled respectively, and may be fixed after assembling to be made incapable of being disassembled.

FIG. 15 is a drawing that shows another spinning top 1200 of the present embodiment. As shown in FIG. 15, the spinning top 1200 is characterized to include a rotating shaft 1210 and a rotating outer circumference section 1220 that is attached to the outer circumference of the rotating shaft 1210 so as to be coaxial with the rotating shaft 1210, and to be further provided with an armor section 1230. The armor section 1230 is attached to the outer circumference of the rotating outer circumference section 1220 so as to be coaxial with the rotating shaft 1210.

The rotating shaft 1210 is substantially similar to the rotating shaft 11 of the first embodiment. As shown in FIG. 15, the rotating outer circumference section 1220 includes a tapered section 1224 that is for tapered surface fitting against the rotating shaft 1210, and to include a tapered section 1226 so as to be capable of tapered surface fitting of the armor section 1230 to the outer circumference side coaxially.

As shown in FIG. 15, with respect to the spinning top 1200, the armor section 1230 is not arranged at the upper surface of the rotating outer circumference section 1220, and is arranged only on the outer circumference side, in a case of such configuration, it is possible to cover the upper surface of the armor section 1230 and the rotating outer circumference section 1220 by a fixation plate 1250, and to screw the fixation plate 1250 and the upper surface of the armor section 1230 by fixation screws 1240. Thereby, the armor section 1230 and the rotating outer circumference section 1220 can be fixed to each other.

When the fixation plate 1250 is arranged thus, the shape of the rotating shaft 1210 can be reversed. That is to say, the rotating shaft 1210 of the spinning top 1200 has such shape that a lower (front) portion contacting the floor has a generally hemispherical shape and the minimum outside diameter section of the tapered section 1224 and the tapered section 1224 continuing thereto exist slightly above (behind) the portion of the generally hemispherical shape as shown in FIG. 15. When the spinning top 1200 rotates, although a force is received from below, by the fixation plate 1250, there is no possibility that the rotating shaft 1210 is disassembled. Also, even when a spinning top has not an armor section, the direction of the rotating shaft can be reversed by arranging such fixation plate, and so on.

Above, the construction of the spinning top 1100 (the spinning top 1200) related to the present embodiment was explained. Next, a method for manufacturing the spinning top 1100 will be explained referring to FIG. 16. Also, because the rotating shaft 1110 and the rotating outer circumference section 1120 can be manufactured similarly to the first embodiment, explanation will be made focusing the armor section 1130 in the present embodiment.

The armor section 1130 is subjected to rotational machining by an NC lathe and the like. After performing the rotational machining, as shown in FIG. 16, the armor section 1130 is subjected to press working and is completed by a press molding machine 1300 that includes a molding machine lower section 1310 and a molding machine upper section 1320. Further, it is also possible to perform rotational machining only without performing press working. Furthermore, it is also possible to perform press working only without performing rotational machining.

(Effects of the Eleventh Embodiment

As explained above, according to the present embodiment, in addition to the effects of the embodiments described above, the armor section can be attached and detached or the armor sections having various forms can be prepared according to necessity, and therefore a top can be set easily in a competition of a top by selecting and combining an optimum one out of components of plural kinds.

Also, because the rotating outer circumference section 1120 and the armor section 1130 can be tapered surface fitted to each other, the rotating shaft 1120, the rotating outer circumference section 1120, and the armor section 1130 can achieve perfect concentricity excellent in balance during rotation. However, it is not imperative that attaching the armor section is by tapered surface fitting. Further, it is also possible that the armor section is not freely assembled and disassembled, but may be fixed to the rotating outer circumference section by screws or other fixation means. Also, a method for manufacturing the armor section 1130 may be by a metallic mold casting method or a sintering method instead of rotational machining by an NC lathe and the like.

Although the preferable embodiments of the present invention were explained above referring to the attached drawings, it is needless to mention that the present invention is not limited to such examples. It is obvious that a person with an ordinary skill in the art can conceive various kinds of alterations or amendments within a scope described in the claims, and it is a matter of course that they are understood to be included in the technical range of the present invention.

For example, although an example that the rotating shaft and the rotating outer circumference section were freely assembled and disassembled was explained in the embodiments described above, the present invention is not limited to it. The rotating shaft and the rotating outer circumference section may be incapable of integrally assembled and disassembled. For example, as shown in FIG. 1 or FIG. 3, it is also possible that the rotating shaft and the rotating outer circumference section are integrated to each other by the O-ring 130 and the screws 230, and are thereafter fixed to each other so as to be incapable of disassembling.

Further, although the configuration of arranging the O-ring (FIG. 1) and the configuration of arranging the thread (FIG. 3) between the rotating shaft and the rotating outer circumference section were explained in the embodiments described above, the present invention is not limited to them. The rotating shaft and the rotating outer circumference section may be made to be freely assembled and disassembled by means other than an O-ring and a thread. Also, when the rotating shaft and the rotating outer circumference section are not made to be freely assembled and disassembled, the O-ring and the thread, do not have to be arranged. Further, it may be configured that the O-ring is arranged in the entire region of the parallel section of the rotating shaft.

Also, although an example that there was the parallel section in the upper part of the spinning top and there was the tapered section in the lower part of the spinning top was explained in the embodiments described above, the present invention is not limited to it. It is also possible that there is the tapered section in the upper part of the spinning top and there is the parallel section in the lower part of the spinning top. In this case, in the rotating shaft, the tip section comes to continue to the parallel section.

Further, although such configuration that the upper part of the tip section was larger than the outside diameter of the lowest surface of the rotating outer circumference section was explained in the embodiments described above, the present invention is not limited to it. Such shape is also possible that the upper part of the tip section is same to or smaller than the outside diameter of the lowest surface of the rotating outer circumference section.

Also, although such example was explained in the embodiments described above that the rotating shaft was configured of metal (titanium material, super hard alloy, stainless steel material, and the like), carbon, or polyacetal resin (alternative material of metal; known as Delrin (registered trade mark)) whose raw material was formaldehyde, hard material having lubricity, and so on, the present invention is not limited to it, and any raw material can be used. The rotating outer circumference section and the armor section also can use any raw material in a similar manner.

The contents of respective embodiments, alterations, and applications explained above can be properly combined and implemented. For example, any combination is possible such that the notch is arranged in the tip section of the rotating shaft (the third embodiment) of the spinning top in which the armor section is arranged (the eleventh embodiment).

REFERENCE SIGNS LIST

100, 200, 1200 Spinning top
110, 210, 1210 Rotating shaft
112 First parallel section
114 First tapered section
116 Tip section
120, 220, 1220 Rotating outer circumference section
122 Second parallel section
124 Second tapered section
130 O-ring
1130, 1230 Armor section

The invention claimed is:

1. A spinning top, comprising:
a rotating shaft; and
a rotating outer circumference section that is detachably fit to the outer circumference of the rotating shaft so as to be coaxial with the rotating shaft, wherein
the rotating shaft includes:
a first parallel section that has a circular cylindrical shape parallel to the rotation axis of the rotating shaft and is fitted to the rotating outer circumference section;
a first tapered section that continues to the first parallel section, inclines by a predetermined angle with respect to the rotation axis of the rotating shaft, and is fitted to the rotating outer circumference section; and
a tip section that continues to the first parallel section or the first tapered section,
the rotating outer circumference section includes:
a second parallel section that is parallel to the rotation axis of the rotating shaft and is fitted to the first parallel section; and
a second tapered section that continues to the second parallel section, has an inclination angle same to the predetermined angle with respect to the rotation axis of the rotating shaft, and is fitted to the first tapered section, and
a plurality of notches are arranged in the tip section at rotationally symmetric positions.

2. The spinning top according to claim 1, wherein
the rotating shaft is formed of either metal or carbon.

3. The spinning top according to claim 1, wherein
the rotating outer circumference section has greater specific gravity and lower hardness compared to the rotating shaft.

4. The spinning top according to claim 1, wherein
the rotating shaft and the rotating outer circumference section are freely assembled and disassembled.

5. The spinning top according to claim 1, wherein
an O-ring is press-fitted between the rotating shaft and the rotating outer circumference section.

6. The spinning top according to claim 5, wherein
the O-ring is arranged in an entire region of the first parallel section.

7. The spinning top according to claim 1, wherein
the rotating shaft and the rotating outer circumference section are fastened to each other by a thread.

8. The spinning top according to claim 7, wherein
the thread is arranged in an entire region of the first parallel section.

9. The spinning top according to claim 1, wherein
the tip section includes a hemispherical section and a protruding section that is arranged at a distal end of the hemispherical section.

10. The spinning top according to claim 1, wherein
an upper part of the tip section is larger than an outside diameter of a lowest surface of the rotating outer circumference section.

11. The spinning top according to claim 1, wherein
a surface roughness of the rotating outer circumference section is made coarse.

12. The spinning top according to claim 1, wherein
a string hooking groove is formed in the rotating outer circumference section.

13. The spinning top according to claim 1, wherein
a through hole, a dent, or a hollow section is arranged in the rotating outer circumference section.

14. The spinning top according to claim 1, further comprising:
an armor section that is attached to the outer circumference of the rotating outer circumference section so as to be coaxial with the rotating shaft.

15. The spinning top according to claim 14, wherein
the rotating outer circumference section includes an armor section side tapered section that inclines by a predetermined angle with respect to the rotation axis of the rotating shaft and is fitted to the armor section.

16. A method for manufacturing the spinning top that is according to claim 14, comprising:
a step for manufacturing the rotating shaft by rotational machining using a lathe;
a step for manufacturing the rotating outer circumference section by rotational machining using a lathe;
a step for manufacturing the armor section by rotational machining using a lathe; and
a step for assembling the spinning top by fitting the rotating shaft and the rotating outer circumference section to each other and attaching the armor section to the outer circumference of the rotating outer circumference section.

17. A method for manufacturing the spinning top that is according to claim 14, comprising:
a step for manufacturing the rotating shaft by a sintering method;
a step for manufacturing the rotating outer circumference section by a sintering method;
a step for manufacturing the armor section by a sintering method; and
a step for assembling the spinning top by fitting the rotating shaft and the rotating outer circumference section to each other and attaching the armor section to the outer circumference of the rotating outer circumference section.

18. A method for manufacturing the spinning top that is according to claim 1, comprising:
a step for manufacturing the rotating shaft by rotational machining using a lathe;
a step for manufacturing the rotating outer circumference section by rotational machining using a lathe; and
a step for assembling the spinning top by fitting the rotating shaft and the rotating outer circumference section to each other.

19. The method for manufacturing a spinning top according to claim 18, wherein
after the step for manufacturing the rotating shaft by rotational machining, the rotating shaft is subjected to a process of any one of or combining a plurality of a quenching process, a titanium coating process, a plating process, or a mirror-polish finishing process.

20. The method for manufacturing a spinning top according to claim 18, wherein
the rotating outer circumference section is formed of aluminum, and
a step for subjecting the rotating outer circumference section to an alumite process for coloring is included.

21. A method for manufacturing the spinning top that is according to claim 1, comprising:
a step for manufacturing the rotating shaft by a sintering method;
a step for manufacturing the rotating outer circumference section by a sintering method; and
a step for assembling the spinning top by fitting the rotating shaft and the rotating outer circumference section to each other.

* * * * *